United States Patent [19]

Skipper

[11] Patent Number: 5,012,866

[45] Date of Patent: May 7, 1991

[54] DRILL STEM MUD WIPING APPARATUS

[76] Inventor: Uvon Skipper, 7409 S. Rice Ave., Bellaire, Tex. 77401

[21] Appl. No.: 517,303

[22] Filed: May 1, 1990

Related U.S. Application Data

[63] Continuation-in-part of Ser. No. 396,233, May 8, 1990, Pat. No. 4,923,011.

[51] Int. Cl.[5] ..... E21B 12/06; E21B 33/08; E21B 37/00

[52] U.S. Cl. ..... 166/170; 166/177; 166/311

[58] Field of Search ..... 166/311, 177, 170, 174, 166/176; 101, 148, 153, 187, 192; 134/22.1, 22.12; 175/316, 318; 15/104.05, 104.061

[56] References Cited

U.S. PATENT DOCUMENTS

| | | | |
|---|---|---|---|
| Re. 20,546 | 11/1937 | Otis . | |
| 1,949,498 | 3/1934 | Stone et al. . | |
| 2,052,006 | 8/1936 | Taylor . | |
| 2,114,373 | 4/1938 | Edwards . | |
| 2,274,940 | 3/1942 | Stoddard . | |
| 2,460,481 | 2/1949 | Abel . | |
| 2,577,068 | 12/1951 | Baker . | |
| 2,578,900 | 12/1951 | Ragan . | |
| 2,598,512 | 5/1952 | Cypher . | |
| 2,633,202 | 3/1953 | Hartsell . | |
| 2,739,652 | 3/1956 | Hartsell . | |
| 2,740,480 | 4/1956 | Cox | 166/170 |
| 2,806,532 | 9/1957 | Baker et al. . | |
| 2,880,805 | 4/1959 | Nelson et al. . | |
| 3,052,302 | 9/1962 | Lagucki . | |
| 3,164,210 | 1/1965 | Lewis . | |
| 3,276,520 | 10/1966 | Arnold . | |
| 3,294,173 | 12/1966 | Hodges . | |
| 3,378,069 | 4/1968 | Fields . | |
| 3,394,763 | 7/1968 | Page, Jr. | 166/311 X |
| 3,485,297 | 12/1969 | Sutliff . | |
| 4,285,402 | 8/1981 | Brieger | 166/311 |
| 4,287,948 | 9/1981 | Haggard | 166/170 |
| 4,580,635 | 4/1986 | Radford et al. | 166/311 |

FOREIGN PATENT DOCUMENTS

| | | |
|---|---|---|
| 826475 | 11/1969 | Canada . |

OTHER PUBLICATIONS

Safe Trip Mud-Slugger, Brochure, Houston, Tex.

*Primary Examiner*—Stephen J. Novosad
*Attorney, Agent, or Firm*—Gunn, Lee & Miller

[57] ABSTRACT

A wiping tool for free fall in a drill stem is disclosed. The wiping tool is adapted to be dropped in the drill stem to wipe the inner wall. It is constructed with an elongate mandrel terminating at upper and lower subs. The upper sub supports a fishing neck and the lower sub encloses a check valve assembly. Adjustable weight means are affixed to the lower sub. Wiping is accomplished by an elongate sleeve having narrow upper and lower ends slideably mounted on the central mandrel, and the sleeve is enlarged at central portions to a diameter sufficient to wipe the wall of internal upset pipe, and wherein said sleeve is resilient, and is therefore able to reduce in diameter on passing through an internal upset and resiliently restores to the initial diameter after passing through the upset. A closed system stores incompressible fluid to keep the sleeve filled and inflated.

19 Claims, 2 Drawing Sheets

DRILL STEM MUD WIPING APPARATUS

BACKGROUND OF THE DISCLOSURE

This apparatus is directed to a device to be placed in a drill stem at the time that the drill stem is pulled from the well borehole during drilling and, more particularly, is a device for weighting the column of mud in the drill stem. This is a continuation-in-part of U.S. Pat. No. 4,923,011 issued on May 8, 1990 which is incorporated by reference.

During drilling of a well, it is necessary to periodically remove the drill stem from the borehole, typically to replace the drill bit. When this occurs, the drill stem is normally lifted up and disassembled joint by joint or perhaps stand by stand. In the process of removing the pipe from the borehole, it is normally lifted in a wet condition and, upon unthreading, may spill drilling fluid on the rig floor creating a risky condition. Moreover, this destroys the hydrostatic balance which existed in the borehole. Heretofore, this has been overcome by slugging the column of mud in the drill stem with a slug of drilling fluid of heavier density so that it will tend to keep the level of mud down in the drill pipe due to the hydrostatic unbalance created on slugging. In the case of oil base muds, it requires the addition of weight material which has to be removed for best results when drilling is resumed.

The apparatus set forth in the parent disclosure hereof is thought to be a successful device which provides the necessary wiping inside the drill stem. This disclosure, however, sets out a further improvement which is directed to the resilient sleeve 25. In the referenced parent disclosure, the sleeve 25 is a resilient sleeve which is supported between upper and lower rings 27 and 28. It is made of resilient material so that it can flex and it tends to inflate, bowing outwardly to create a contact area which tends to wipe the inside of the pipe. Ordinarily, it provides contact against the full circle of the surrounding or enclosing axial passage through the drill stem. There are, however, internal upsets which are encountered periodically along the drill stem. When they are encountered, this requires the sleeve to contact against the upset regions, thereby shrinking to prevent leakage past the upset region. The present improvement sets forth a method and apparatus for further assuring that the sleeve is expanded radially outwardly so that the sleeve maintains more reliable contact with the surrounding drill stem, in particular better contact with the surrounding drill stem. Thus dynamically, the device will pass downwardly in a drill stem, being forced to shrink or narrow on encountering the internal upset, and is freed to expand radially outwardly after passing through the upset so that the present apparatus provides a more sure and certain contact region just below the upset. It is very helpful to maintain the resilient sleeve 25 at a fully inflated condition for assuring contact against the surrounding upset and the sidewall just below the upset. In the absence of certain contact, it is possible for leakage to occur and this system overcomes that tendency.

The present system has the further advantage of overcoming the tendency to leak by assuring a fully inflated sleeve during traversing of a drill stem. Moreover, the sleeve is filled with an incompressible fluid which is momentarily compressed when passing through an internal upset which fluid overflows from the sleeve into a chamber. The chamber is maintained under pressure which is assured by a cylinder in the chamber exposed to ambient pressure. Pressure on the tool dynamically moves the piston within the cylinder to adjust pressure equalization within the sleeve. This change in piston location maintains fluid pressure within the tool keeping the sleeve expanded in light of its physical location relative to upsets of the drill stem.

The present apparatus sets out an elongate tool which is buoyantly carried on the top of the mud column in the drill stem as the stem is being pulled and which includes a central elongate mandrel. The mandrel is of relatively narrow diameter to receive thereon a telescoped and slideable resilient sleeve. The resilient sleeve is not shaped as a cup, but rather incorportes upper and lower ends which are relatively narrow and are mounted on circular rings to enable telescoping movement of each end independently on the mandrel. The sleeve bows outwardly at the central portions and defines a resilient wiping surface. This surface is able to pass through the internal upset pipe. When it does, the sleeve is constricted slightly, forcing the two ends farther apart and which are both free to move. The two ends of the sleeve are arranged in a circular construction around the mandrel. Conveniently, shoulders at the upper and lower ends of the sleeve supported by the mandrel define the centered sleeve position, but such sleeve movement is nevertheless permitted during transition through an internal upset. The transition thus occurs as the device is traveling through the drill stem and yet permits the sleeve to slide through the internal upset, shrinking at the fatter central portion, forcing the two ends thereof relatively apart, and moving at one end or the other to accommodate appropriate elongation on diametric shrinkage, and further restoring to the original shape after transition through the internal upset. This is markedly different from cups which face upwardly or downwardly. Likewise, it is different from sleeves of substantially uniform diameter, and is substantially different from the wiping action provided by such devices.

The foregoing briefly sets out certain aspects of the present disclosure, but details of the present apparatus will become more readily apparent and understood in conjunction with the drawings of the preferred embodiment, and it is therefore a structure including the components illustrated discussed below for the preferred embodiment.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typically embodiments of this invention and are therefore not to be considered limiting of its scope, for the invention may admit to other equally effective embodiments.

DETAILED DESCRIPTION OF THE PREFERRED EMBODIMENT

Before beginning with a description of the present disclosure, the disclosure found in the above referenced patent 4,923,011 is hereby incorporated by reference. It explains generally the wiping action which occurs in the apparatus, particularly when a drill stem is pulled from a well borehole which is normally filled with drilling fluid. The fluid is located on the exterior and interior of the pipe. In particular, there is a standing column of drilling fluid accumulated in the pipe as it is pulled from well. A typical procedure envisions disassembly of the drill stem stand by stand. A stand is normally three joints of pipe which have an aggregate length of about ninety to ninety-five feet in length. One stand of pipe is normally unthreaded and pushed to the side so that it stands erect in the derrick. It is stored momentarily there as the entire drill stem is disassembled and stored. As will be understood, these operations are accomplished quite rapidly. As each stand is unthreaded, there is a substantial mess created as drilling fluid within that stand of pipe drips on the rig floor, making the work far more dangerous than it should be. The foregoing disclosure is directed to a wiping device which assists in wiping the drill stem on the inside. This reduces the spillage of drilling fluid. Moreover, it serves as a safety device in the event there is an unwanted pressure surge from the well. The pressure surge might otherwise travel up through the string of drill pipe.

The present version particularly focuses on improvements in the expandable of flexible sleeve 25. Specifically, it is expanded and heling in wiping contact both at the internal upsets and as it traverses the length of the drill pipe.

Figure 1:
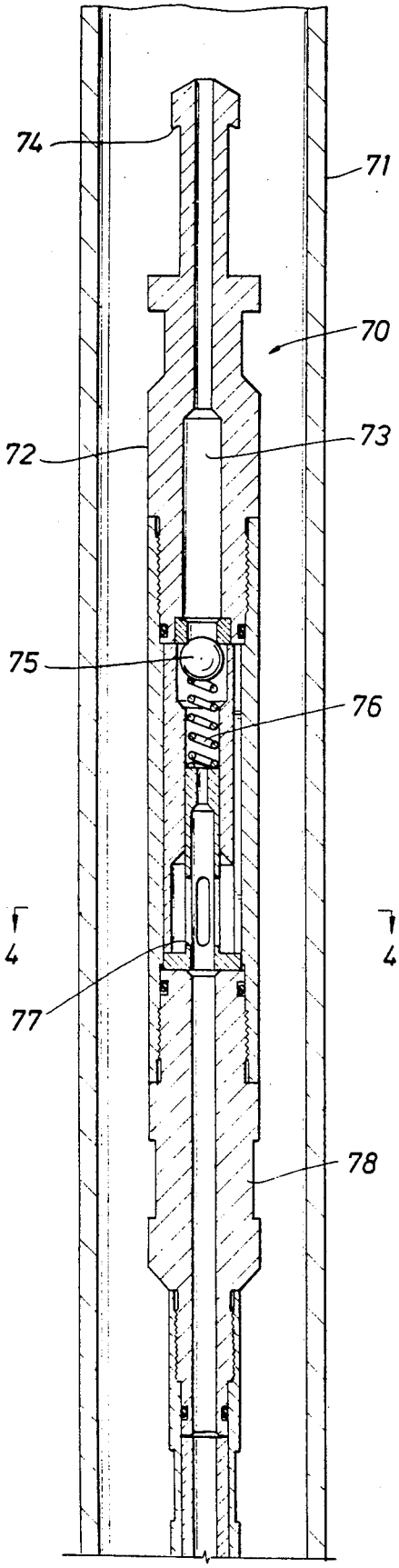
FIGS. 1, 2 and 3 serially show in sectional view the improved embodiment of the present apparatus which incorporates a sleeve for wiping the interior of a drill pipe as might occur in pulling a string of drill pipe from a well a thereby reduce spillage as the drill pipe is removed from a well.
Figure 2:
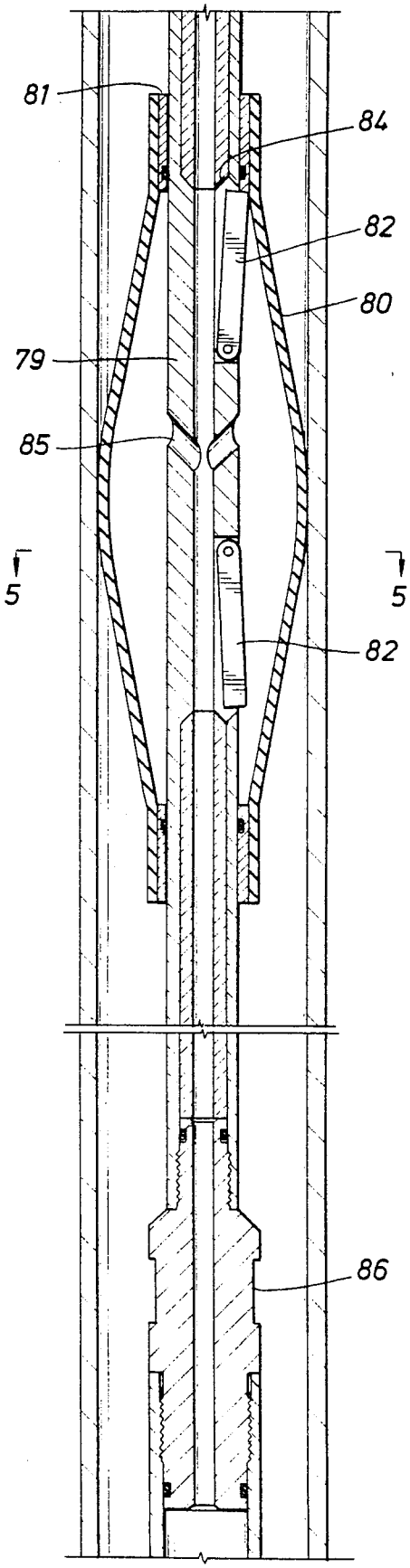

The further improvement will therefore be described by referring generally to the construction of the device 50. It can also be constructed with slips as exemplified in the embodiment 50 of the foregoing embodiment. In any case, the numeral 70 identifies the improved drill stem mud wiping apparatus which is positioned in a string of drill pipe 71. There is a hollow sub 72 at the upper end which is provided with an axial passage 73 from the upper end. The upper end, of course, includes a fishing neck 74 (of conventional shape) which enables the device to be retrieved by means of conventional overshot tools. The sub 72 communicates with a check valve 75 biased by a spring 76 to permit downward flow. Flow upwardly through the passage 73 is prevented by the check valve 75 which incorporates a sphere larger than the valve seat confronting it. The sphere is held in contact with the seat by the coil spring 76. When the fluid pressure acting downwardly against the sphere exceeds a predetermined pressure level, the spring is forced open, and fluid flow then occurs. A supportive sleeve includes multiple ports or openings to the exterior and axially of the spring 76 which extend downwardly to an opening 77. This communicates downwardly into the elongate stem or mandrel 78. The mandrel 78 extends from FIG. 1 downwardly to the sleeve which will be discussed and which is shown better in FIG. 2. There is a central mandrel 79. This mandrel 79 is concentric within a resilient sleeve 80 which is inflated with fluid and forced to expand, expanding something in the fashion of a balloon. It has a stiff ring 81 at the upper end. The ring 81 is similar to that disclosed in the foregoing embodiment and is therefore able to telescope on the exterior of the mandrel.

Both ends of the resilient sleeve 80 are constructed in the same fashion and they are both able to telescope. That is, they can slide to and fro around the central mandrel 79. The range of travel, however, is limited by shoulders which are on the interior of the sleeve. There is an upwardly facing shoulder and a downwardly facing shoulder also is included. In this particular instance, the shoulders are not continuous shoulders machined in the mandrel as set forth in the foregoing disclosure. Rather, the shoulders here comprise protruding levers 82, therebeing preferably three or four at the top end and three or four at the bottom end. When these levers 82 collectively protrude, they define a shoulder which prevents the stiffened ring 81 from traveling any farther than the shoulder will permit. These shoulders are defined by pivotally mounted elongate levers. These levers have a retracted position which can be fully withdrawn so that the sleeve 80 and the associated end located rings 81 will slide over and past the shoulders. This is helpful during assembly. The shoulders, however, being pivotally mounted, are able to deflect radially outwardly into the abutting location shown in FIG. 2 of the drawings. The shoulders are forced outwardly by the concentric construction of the multiple parts of the mandrel at 78 and 79. It will be observed that the mandrel is formed of two concentric parts. The mandrel 79 thus has an elongate window cut for the finger like levers 82, having a pivot at one end of the deflected fingers. They are forced outwardly by the mandrel end located chamfered undercuts 84. At the time of assembly, these undercuts are threaded in position on the central mandrel portion 79 to initiate lateral deflection thereby forcing the finger shaped levers 82 radially outwardly.

The passage through the mandrel 79 communicates to the interior of the sleeve 80 by suitable ports 85. The ports 85 are included so that fluid in the mandrel passage can fill the interior of the sleeve 80. This fluid is under pressure. The actual pressure noted will be discussed in relationship to the pressure balance that is achieve in the system hereinafter.

There is no leakage from the interior of the sleeve 80. The stiff ring 81 supports an inwardly directed seal member which is preferably an O-ring which holds against the pressure within the sleeve so that expansion and leakage does not occur. Even when there is a pressure build up within the sleeve, there is essentially no leakage. The stiff ring 81 is preferably bonded to or otherwise adhesively joined with the upper end of the sleeve so that there is no leakage at this interface. The same is also true at the lower end so that symmetrical construction prevents leakage at either end.

Figure 3:
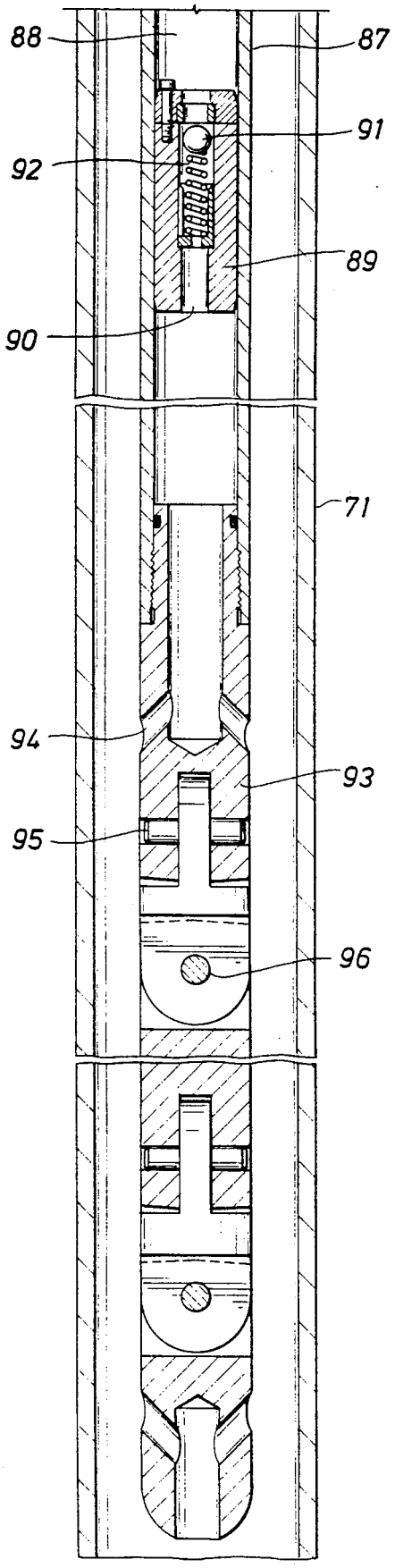
Figure 4:
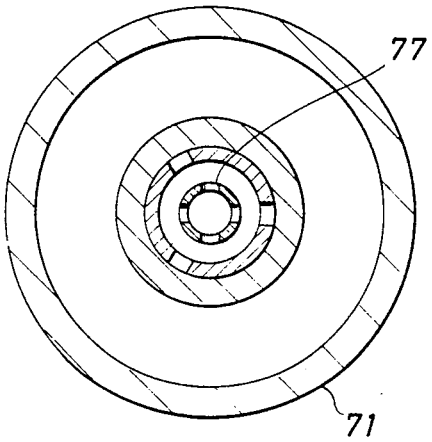
FIG. 4 is a sectional view along the line 4—4 of FIG. 1 showing internal details of construction of the apparatus.
Figure 5:
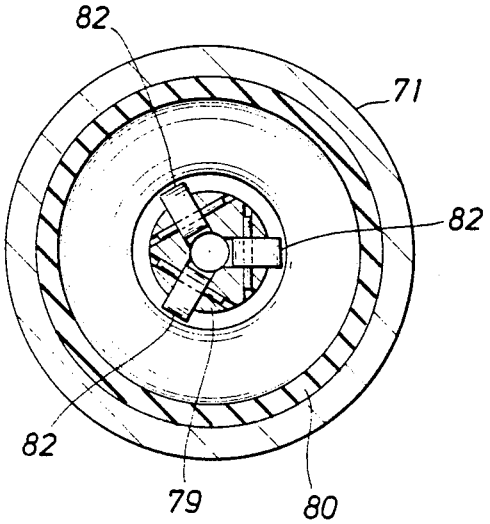
FIG. 5 is a sectional view through the expanded wiper portion which is constructed in the form of a sleeve showing details which lock the sleeve in position.

The mandrel 79 is one of the multiple pieces as mentioned above and extends downwardly to an enlarged mandrel portion 86, and this in turn connects with an elongate hollow cylindrical member 87. This defines a fluid receiving chamber 88 shown at the top of FIG. 3. This chamber is sufficiently large to match, or even more than match, the volume within the sleeve 80 for reasons to be defined. The chamber 88 is closed by a floating piston. The piston 89 can move upwardly and downwardly within the chamber. The piston 89 is constructed with an axial passage 90 opening therethrough. There is an axial fluid flow path through the passage 90. Fluid flow from this passage must dislodge the check valve 91 from its seat. This valve has the preferred form of a sphere which is forced against the seat by a resilient spring 92. The spring forces the check valve to a closed condition unless pressure overcomes the check valve spring. Again, the relative pressure on the check valve will be discussed below in detail. The piston 89 is floating in the sense that it can move upwardly or downwardly. The initial filling of the system with a particular fluid will be descried so that the piston is forced to a particular location. Pressure balance is achieved within the system while the piston 89 is subject to movement along the cylindrical chamber 88.

The fluid flow path extends downwardly from the passage 90 into the sub 93 and flows to the exterior through the laterally directed ports 94. Therebelow, weight bars or sinkers are included. The sub 93 supports a pivot 95 which provides one degree of freedom, and there is another degree of freedom at the pivot 96 therebelow. The two pivots or degrees of freedom are at right angles. This permits the weight bars to snake through the drill pipe even though they may be several feet in length. This type of U-joint, referring to the pivots 95 and 96, is repeated at various locations along the weight bars. Conveniently, the weight bars are assembled by positioning the pins 95 and 96 in the matching passage as indicated in this construction. One or more weight bars can be included. The range of angular deflection at an individual pivot is almost ninety degrees; referring to the pin 96, it is at right angles with respect to the other pin so that the weight bar therebelow is able to pivot substantially to the left or right and at right angles.

MODE OF OPERATION

As a preliminary matter before use, the piston 89 is located at a particular location by a support stand inserted from below the piston. It is preferably located at some mid location so that it will not bottom out at either end of possible travel. An incompressible fluid which is preferably water is pumped into the apparatus. Air is voided by pressing the check valve 75 downwardly from above. Only slight pressure is required, and it should be sufficient to dislodge the ball downwardly with a rod to enable filling. Water is placed in the tool by inverting the tool with surplus water forced out through the check valve 75. The equipment thus is filled with water, and is preferably filled while in the upright inverted position to permit air bubbles to escape. It is preferably filled to the extent that the sleeve 80 is expanded outwardly to its normal diameter. In summary, fluid filling is the initial step accomplished before use.

When it is time to remove the drill stem from a well as typically occasioned on changing drill bits, the wiping apparatus 70 is dropped into the drill string from the top end at the rig floor. It will fall in the drill string until it encounters mud. It assumes a buoyant position floating on the top of the column of drilling fluid. In this posture, the sleeve 80 expands to fill the pipe cross-sectional area and to provide a wiping surface. Assume for the moment that there is no drilling fluid above the sleeve 80 and wiping occurs as it moves relatively downwardly along the stand of pipe moving upwardly. Wiping occurs in the routine fashion. As the wiping forces the drilling fluid downwardly, the drill pipe can be pulled upwardly. Eventually, the wiping apparatus 70 will encounter an internal upset. When an upset relatively approaches the sleeve 80, the shoulder at the end of the upset will encounter the gently sloping external face of the sleeve 80 and begin compression hereof. The sleeve is compressed as the wiping apparatus 70 is pulled through the region where the internal upset is located. This is accomplished with substantial compression. Prior to the upset, the sleeve was full gauge, being held in that position by water on the interior. The water, however, is forced out of the sleeve 80. Water is then forced into the passage 73. It cannot flow upwardly because it kept in the passage by the topmost check valve 75. It flows downwardly, creating expansion room by forcing the piston 89 downwardly in the chamber 88. The spring 92 in the bottom check valve is sufficiently strong that the piston will move before the check valve will open. This enables the piston to move to accomodate an increase in the chamber 88 volume occasioned by the reduction in diameter of the sleeve 80. In other words, the chamber 88 becomes longer as the piston moves downwardly; the piston 89 moves upwardly when the sleeve expands. The piston 89 is opposed by the prevailing pressure in the drilling fluid. The piston 89 is forced upwardly in response to prevailing pressure to force the incompressible water out of the cylinder 88 back into the expandable sleeve 80 whereby the sleeve maintains its wiping contact during and after the upset. In other words, this occurs even after the upset has relatively moved upwardly past the sleeve so that the lower side of the upset and the pipe just below the upset is likewise successfully wiped. Continual sleeve contraction and expansion is permitted by this arrangement.

Another important factor in the operation of the present device is the ability to pump through the device. In the unlikely event that a pressure surge comes from a blowout below which would otherwise force mud to flow upwardly through the drill string, the mud flow will tend to lift the present apparatus somewhat. Drilling fluid, however, cannot force its way upwardly through the central passage because the check valves are arranged to prevent this. If there is an upward surge on the exterior of the wiping apparatus 70, the entire assembly might be carried upwardly until the expanded sleeve 80 encounters the internal upset at the pipe joint thereabove. When this occurs, the present apparatus will be slowed but may continue to be lifted upwardly. It will, however, serve as a brake on rapid upward flow as might occur with a blowout. Indeed, a blowout is retarded, even prevented. This, of course, depends on the relative pressure drive behind the blowout.

Another important factor in the present apparatus is the ability to pump from above. Assume that a blowout has occurred, but that it is only a partial blowout in that the wiping apparatus has been lifted somewhat from an initial position along the drill stem. If fluid flow is established by reconnecting the mud line to the top end of the drill string, then fluid can be forced downwardly. It can flow through the passage 73 and dislodge the check valves which are biased to permit downwardly flow. That is, a slug of heavy weight material can be pumped through the present apparatus to reestablish control over the blowing well. At any time, the present apparatus can be retrieved by grappling the top end of it with a fishing tool such as an overshot which is used to retrieve the present apparatus.

While the foregoing is directed to the preferred embodiment, the scope thereof is determined by the claims which follow.

What is claimed is:

1. A wiping apparatus adapted to be placed in a drill stem including internal upset pipe when pulling the drill stem from a well borehole, the apparatus comprising:
(a) an elongate mandrel;
(b) an elongate sleeve telescoped around said mandrel for wiping movement thereabout wherein said sleeve comprises:
(i) spaced upper and lower ends having a sufficiently narrow diameter to pass through internal upsets of the internal upset pipe;
(ii) a central wiping portion between said ends thereof and sized to contact the inside wall of the pipe making up the drill stem; and
(iii) said sleeve being formed of resilient material permitting reduction in diameter when encountering an internal upset in the pipe making up the drill stem; and
(c) mans for inflating said sleeve and causing said sleeve to expand radially outwardly to contact against and wipe the inside wall of the pipe and wherein said inflating means deflates and inflates said sleeve on entry into and departure from internal upsets of the drill stem.

2. The apparatus of claim 1 wherein said sleeve further includes fixed diameter, end located rings formed of stiff material and said rings encircle said mandrel, and further including means permitting controlled ring movement along said mandrel.

3. The apparatus of claim 2 wherein said rings are attached to said sleeve, and said sleeve has said central bulge symmetrically between said ends, and said mandrel extends above and below said sleeve to support and align said sleeve within drill pipe; and
further including upper and lower means supported by said mandrel and having a shoulder to align said sleeve relative to internal upsets in drill pipe so that the ends of said sleeve pass through internal upsets without hanging and said sleeve bulge contacts a surrounding internal upset circumferentially.

4. The apparatus of claim 3 further including a chamber within said central expanded bulge and said chamber partially collapses on contact of an internal upset with said sleeve.

5. The apparatus of claim 1 wherein said mandrel includes an upper shoulder facing upwardly, and a lower shoulder facing downwardly, and said shoulders permit movement of said sleeve within limits established by said shoulders, and wherein said sleeve can elongate on passing through an internal upset to thereby move one or the other end of said sleeve away from said shoulders.

6. The apparatus of claim 5 wherein said shoulders comprise deflected links pivotally mounted on said mandrel.

7. The apparatus of claim 1 including adjustable weight means which comprises:
(a) an enlarged body portion at the lower end of said mandrel;
(b) a weight bar; and
(c) universal joint means connecting said weight bar to said body portion and further including locking means removably fastened to secure said locking means therein.

8. The apparatus of claim 7 including multiple weight bars connected below said mandrel.

9. The apparatus of claim 1 wherein said mandrel supports:
(a) an upper sub at the top end thereof;
(b) a lower sub at the lower end thereof;
(c) passages in said upper and lower subs connecting to a mandrel passage; and
(d) upper and lower check valves serially in said upper and lower subs for limiting fluid flow direction along said sub passages.

10. The apparatus claim 1 wherein said mandrel supports an enlarged sub at the upper end and said sub has an industry standard fishing neck thereon, and said mandrel supports a separate sub at the lower end, and said lower sub includes an outlet for a passage through said mandrel, and said mandrel passage connects to a check valve means within the lower sub.

11. The apparatus of claim 1 wherein said sleeve is circular in cross section, bowed symmetrically between the ends thereof to or greater than the inside diameter of drill pipe in the drill stem.

12. The apparatus of claim 1 wherein said inflating means includes:
(a) a closed chamber for fluid in said mandrel;
(b) passage means from said chamber to said sleeve for inflating said sleeve; and
(c) means for maintaining pressure on said chamber to main said sleeve inflated.

13. The appratatus of claim 12 wherein said closed chamber is an elongate hollow chamber in said mandrel, and further including a piston therein for closing said chamber.

14. The apparatus of claim 13 wherein said piston has two end located faces with one face in contact with fluid in said chamber and the other face in contact with drilling fluid in the well borehole.

15. The apparatus of claim 14 wherein said pressure maintaining means comprises said piston with a passage therethrough, and includes a check valve in said piston passage to limit flow to a single direction.

16. A method of pulling a dry pipe joint on tripping a drill stem from a well borehole, the method comprising the steps of:
(a) at the upper end of the drill stem, dropping a mandrel supported sleeve into the drill stem;
(b) sizing the lower end of the sleeve on the mandrel sufficiently small so that said sleeve passes through an internal upset of the pipe;
(c) inflating said sleeve to wipe the pipe wall and force drilling fluid downwardly as wiped;
(d) reducing the diameter of the inflated sleeve on passing through an internal upset in the drill stem;
(e) inflating said sleeve after passing through upsets to force said sleeve to expand and circumferentially wipe the pipe; and
(f) removing the top most drill pipe after wiping.

17. The method of claim 16 including the step of permitting axial movement of the sleeve along the mandrel between limits.

18. The method of claim 16 including the step of storing a supply of incompressible fluid in a chamber means, and pumping fluid between said chamber means and said sleeve wherein pumping keeps said sleeve expanded into contact with the pipe wall and upsets notwithstanding changes in diameter.

19. The method of claim 16 including the step of controllably weighting the mandrel to fall to drilling fluid in the drill stem while maintaining the mandrel centered sleeve above the drilling fluid.

* * * * *